US007767005B2

(12) United States Patent
Gale

(10) Patent No.: US 7,767,005 B2
(45) Date of Patent: Aug. 3, 2010

(54) TUNNEL FAN ELECTROSTATIC FILTER

(76) Inventor: Roger A Gale, Sveavegen 3, N-1263, Oslo (NO)

( * ) Notice: Subject to any disclaimer, the term of this patent is extended or adjusted under 35 U.S.C. 154(b) by 49 days.

(21) Appl. No.: 11/630,758

(22) PCT Filed: Jun. 22, 2005

(86) PCT No.: PCT/NO2005/000221

§ 371 (c)(1),
(2), (4) Date: Nov. 15, 2007

(87) PCT Pub. No.: WO2006/001705

PCT Pub. Date: Jan. 5, 2006

(65) Prior Publication Data

US 2008/0295694 A1 Dec. 4, 2008

(30) Foreign Application Priority Data

Jun. 23, 2004 (NO) ..... 20042633

(51) Int. Cl.
*B03C 3/41* (2006.01)

(52) U.S. Cl. ..... 96/97; 55/DIG. 38; 96/63; 96/100

(58) Field of Classification Search ..... 96/61, 96/63, 69, 97–100; 55/DIG. 38
See application file for complete search history.

(56) References Cited

U.S. PATENT DOCUMENTS

| | | | | | |
|---|---|---|---|---|---|
| 2,505,907 | A * | 5/1950 | Meston | 96/97 |
| 2,711,226 | A | 6/1955 | Davis, Jr. | |
| 3,157,479 | A * | 11/1964 | Boles | 96/82 |
| 3,485,011 | A * | 12/1969 | Reed et al. | 95/81 |
| 3,765,154 | A * | 10/1973 | Hardt et al. | 96/88 |
| 3,957,462 | A * | 5/1976 | Schminke et al. | 96/97 |
| 4,010,011 | A * | 3/1977 | Reif | 96/61 |
| 4,247,307 | A * | 1/1981 | Chang | 95/79 |
| 5,254,155 | A * | 10/1993 | Mensi | 96/44 |
| 5,348,571 | A * | 9/1994 | Weber | 96/68 |
| 6,228,148 | B1 * | 5/2001 | Aaltonen et al. | 95/74 |
| 6,858,064 | B2 * | 2/2005 | Bologa et al. | 95/65 |
| 2001/0029842 | A1 * | 10/2001 | Hoenig | 96/63 |

FOREIGN PATENT DOCUMENTS

| | | |
|---|---|---|
| AT | 121928 | 3/1931 |
| DE | 533035 | 8/1931 |

(Continued)

OTHER PUBLICATIONS

English abstract of JP 9-262498 dated Oct. 7, 1997.

(Continued)

*Primary Examiner*—Richard L Chiesa
(74) *Attorney, Agent, or Firm*—Ladas and Parry LLP

(57) ABSTRACT

An apparatus for filtering particulate matter from a gas. The apparatus includes at least one tube with a substantially axially located ionizer structure, and a fan for propelling the gas through the at least one tube. The ionizer structure includes a flat blade extending axially along at least a substantial part of the tube and having a saw tooth shape with a high number of sharp teeth placed regularly along the blade edges. The blade is twisted about its own longitudinal centerline to provide rotation for a gas stream flowing along the tube.

9 Claims, 7 Drawing Sheets

FOREIGN PATENT DOCUMENTS

| | | | | | |
|---|---|---|---|---|---|
| DE | 717477 | | | 2/1942 | |
| DE | 1457325 | | | 6/1965 | |
| DE | 2018447 | | | 11/1971 | |
| EP | 1 193 445 | | | 4/2002 | |
| GB | 840853 | | | 7/1960 | |
| JP | 56-37061 | A | * | 4/1981 | ..... 96/97 |
| JP | 63-319072 | | | 12/1988 | |
| JP | 4-235759 | A | * | 8/1992 | ..... 96/97 |
| JP | 9-262498 | | | 10/1997 | |
| JP | 2003-70886 | | | 3/2003 | |
| WO | 99/61160 | | | 12/1999 | |
| WO | 00/62936 | | | 10/2000 | |

OTHER PUBLICATIONS

English abstract of JP 2003-70886 dated Mar. 11, 2003.
English abstract of JP 63-319072 dated Dec. 27, 1988.

* cited by examiner

Ioniser
Figure 1
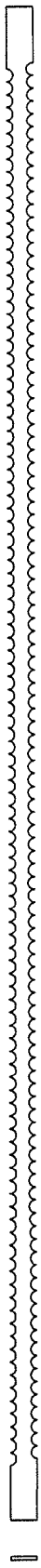
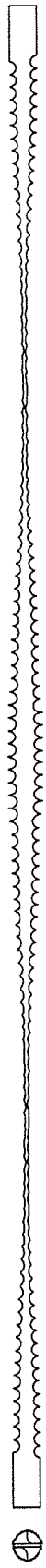
Figure 2

Hexagon cross section

Hexagonal Filter Assembly (cross-section)

Hexagonal Tube Assembly Face View 1.54m³/s 16.3m³/s 54.2m³/s

Filter and Jet/Booster Fan Assembly

Filter High Voltage Contacts

Cylinder/Square tube system drawing

TUNNEL FAN ELECTROSTATIC FILTER

CROSS-REFERENCE TO RELATED APPLICATIONS

The present application is the national stage of International Application No. PCT/NO2005/000221 filed Jun. 22, 2005, which claims the benefit of Norwegian Patent Application No. 20042633 filed Jun. 23, 2004.

TECHNICAL FIELD

The present application relates to apparatus for filtering particulate matter from gasses and more particularly to filters which are adapted to remove particles travelling at high velocities in air streams. Typically these filters will be used fixed to high speed fans such as road tunnel jet or booster fans.

BACKGROUND ART

The prior art includes filters using the principle of electrostatics for removing particles from various gasses, normally air, at velocities up to 10 m/s. The principle here employed is as follows. The air is propelled through an electric field where particles in the air receive an electric charge. The charged particles move into a collector section where each alternate plate is charged with the same polarity as the particles, and repels them. The other set of plates are grounded, which collect the particles. The remaining air, cleaned of the majority of particles, is then re-introduced into the environment. The contaminated plates are cleaned by washing, normally by water/detergent, high pressure air or other means. The particles can be charged positively or negatively depending on the environment and the location of the filter. While the electrostatic filter has evolved over the years there remains two basic operational problems. As the air speed increases so the efficiency decreases and two as the air speed increases so the pressure drop increase so that the running cost becomes prohibitive. It has been acknowledged that at speeds over 10 m/s the filter is no longer feasible to operate.

German publication DE 1457325 discloses an apparatus that utilizes both electrostatic and centrifugal forces. An electrode is arranged centrally in a tube. Gas is driven into helical motion by a tangential inlet arrangement to the tube and by the provision of helical tracks around the centre electrode.

A similar device is disclosed in DE 717477, comprising a central electrode and blades in a tube, for utilizing both electrostatic and centrifugal forces.

WO 99/61160 discloses an arrangement in which a propeller blade at the inlet provides a spiral air flow inside a chamber with a central electrode.

A common feature of all these prior art solutions with center electrode, is that a special air spin generator (tangential gas inlets, special spiral track devices or propellers) is necessary. Further, in devices with a central ionising electrode, this electrode is then a wire situated axially along the tube. The main problem with a wire is that it breaks. This is caused by wire vibrations due to high voltages. The wire vibrates even when there is no air movement.

Hence, there is a need of a strong and self-stabilized center electrode, and generally there is a need of a simpler and less expensive construction than disclosed by the prior art.

SUMMARY OF THE INVENTION

Accordingly, it is the object of this invention to provide an improved electrostatic filter for the filtering of gaseous borne particulate.

It is another object of this invention to provide an improved electrostatic filter which may be easily assembled.

It is a further object of this invention to provide an improved electrostatic filter which may be easily tested for proper assembly.

It is still another object of this invention to provide an improved electrostatic filter whose elements are not easily broken.

It is yet another object of this invention to provide an improved electrostatic filter which may be manufactured with cost savings.

It is yet a further object of this invention to remove particulate from the exhaust produced by the combustion process of fossil fuels.

It is yet another object of this invention to remove the particulate from the air in a tunnel in the event of a fire.

It is yet a further object of the invention to make an electrostatic filter which is reversible without additional parts.

It is another object of the invention to make an electrostatic filter function with little maintenance.

Thus, in accordance with the invention there is provided an apparatus for filtering particulate matter from a gas, comprising at least one tube with a substantially axially located ioniser structure, and a fan for propelling the gas through the at least one tube. The apparatus of the invention is characterized in that the ioniser structure comprises a flat blade extending axially along at least a substantial part of the tube and having a saw tooth shape with a high number of sharp teeth placed regularly along the blade edges, and that the blade is twisted about its own longitudinal centreline in order to provide rotation for a gas stream that flows along the tube.

A filtering apparatus with such an ioniser structure as defined above, is a simplified apparatus where the central ioniser causes the gas flow to rotate and to be ionised at the same time. The saw teeth are effective for ionising the gas borne particles. This apparatus can be used with gas velocities of 30 m/s or even higher. Additional advantages are that the twisted blade structure is much stronger and more reliable than a wire, and it is not susceptible to vibrations like a wire electrode.

The blade twist centreline will normally coincide with the tube axis, but it is also possible to use off-axis constructions.

In a favourable embodiment, the blade has a transverse dimension that is substantially smaller than a tube diameter, for instance in the ratio 1:10.

A collector structure may be arranged among the inside surface of the tube, for receiving electrically charged particulate matter. In this case, the tube may be made of a composite material, while collector structures inside the tube are made of an electrically conducting material connected to electrical ground, while the ioniser structure is connected to a high electrical potential.

In a preferred embodiment, the twisted blade is supported substantially at the tube axis by means of stays that act at the same time as electrical conductors for a high voltage to the blade.

The tube may have a face area that is any of circular, hexagonal and square shaped.

The apparatus of the invention may comprise a number of tubes with hexagonal face areas in a regular close packing.

BRIEF DESCRIPTION OF THE DRAWINGS

FIG. 1 is a plan view of the ioniser before twisting.

FIG. 2 is a plan view of the ioniser after twisting through 360°.

DETAILED DESCRIPTION OF THE INVENTION

The electrostatic filter utilises a series of parallel tubes with a flat 'saw tooth' ioniser running down the centre of the tube. The flat 'saw tooth' ioniser is twisted about its centreline so that the air-stream flowing along the tube is caused to rotate. This rotation causes any particle in that air-stream to move towards the walls of the tube by centripetal force.

The ioniser has a different potential to that of the tube. This causes a corona discharge between the teeth of the ioniser and walls of the tube.

As the particles pass through the corona they are given a charge which has the same potential as the ioniser. This has the effect of repelling the particles from the ioniser and at the same time attracting them to the walls of the tube. When the charged particles come into contact with the tube walls they adhere to the wall until such a time as the charges are removed while the air is still flowing at high speed or they agglomerate to such a size that they are entrained by the air stream.

The tubes can be spherical or hexagonal. If hexagonal they can be sized in such a way as to fit the diameter of a fan.

The tubes can then be fitted to a tunnel jet fan.

The power for the filter is supplied directly to the filter from a high voltage power supply and fixed by a mechanical fixing. Normally a bolt directly through the casing to a high voltage junction box.

Referring more Particularly to the Drawings

Figure 3:
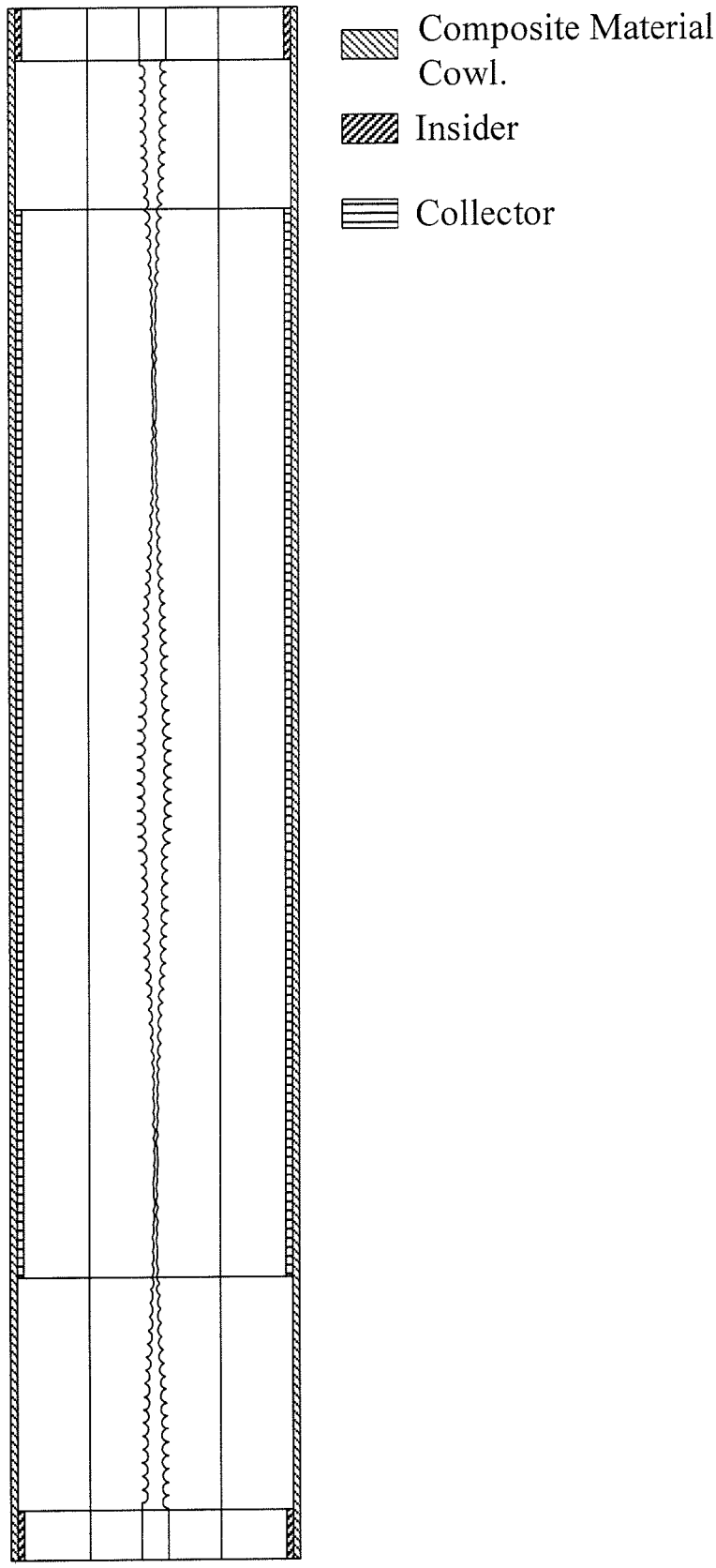
FIG. 3 is a cross-section of the Hexagonal tube with ioniser and collector fitted in a housing.
Figure 4:
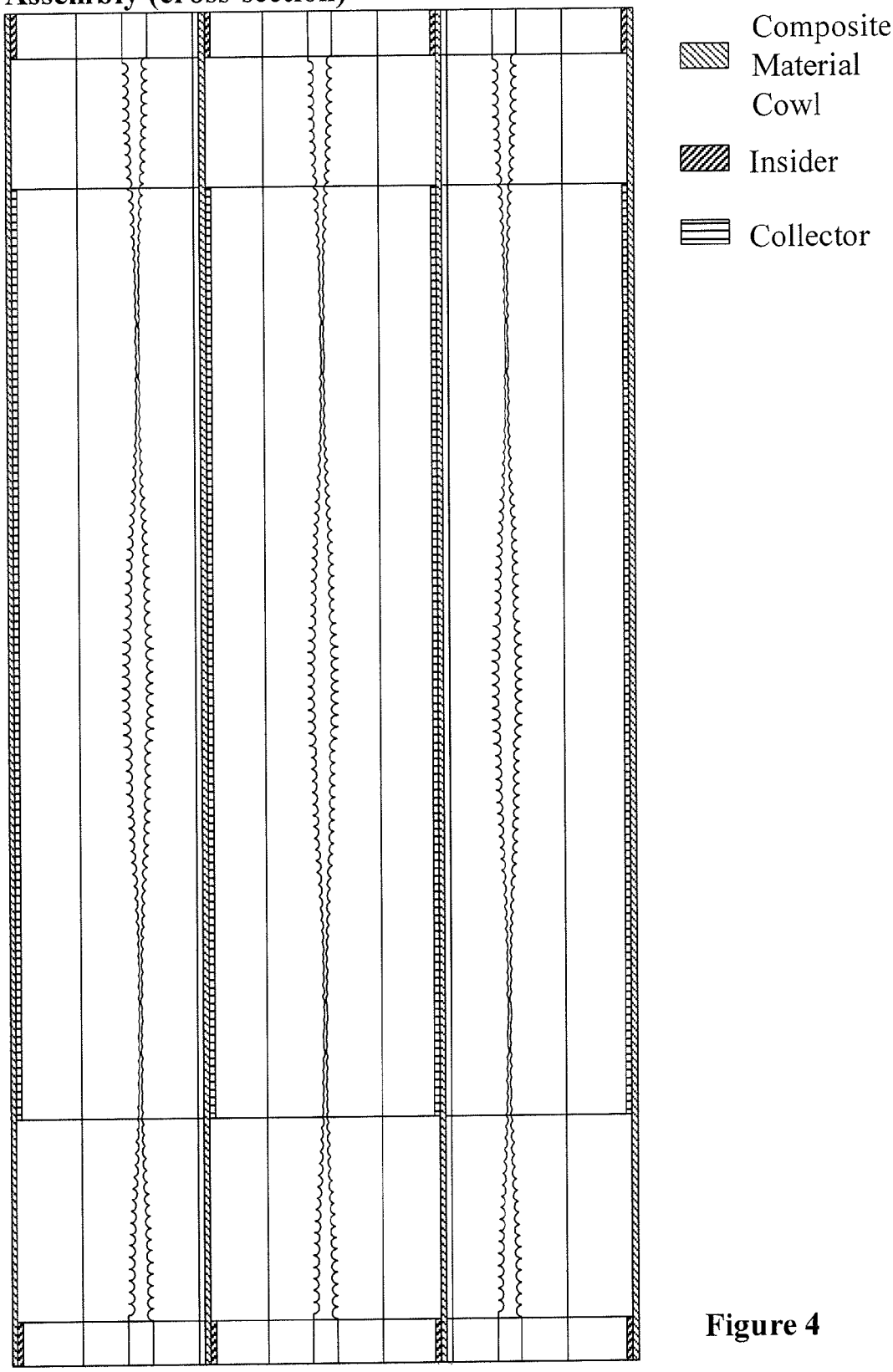
FIG. 4 is a cross-section of a filter assembly for a air volume of 1.54 $m^3/s$.
Figure 5:
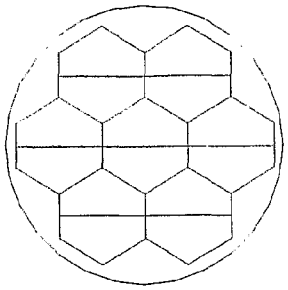
FIG. 5 is the face area of one section of the assembly for an air volume of 1.54 $m^3/s$.
Figure 6:
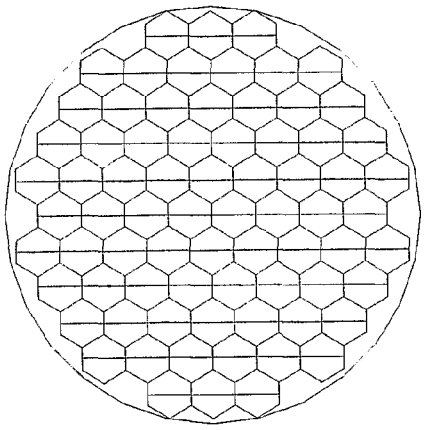
FIG. 6 is the face area of an assembly for an air volume of 16.3 $m^3/s$.
Figure 7:
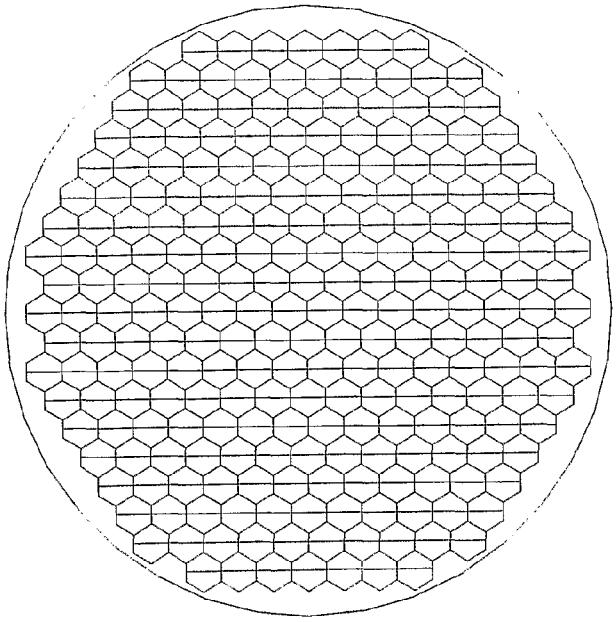
FIG. 7 is the face area of an assembly for an air volume of 54.2 $m^3/s$.
Figure 8:
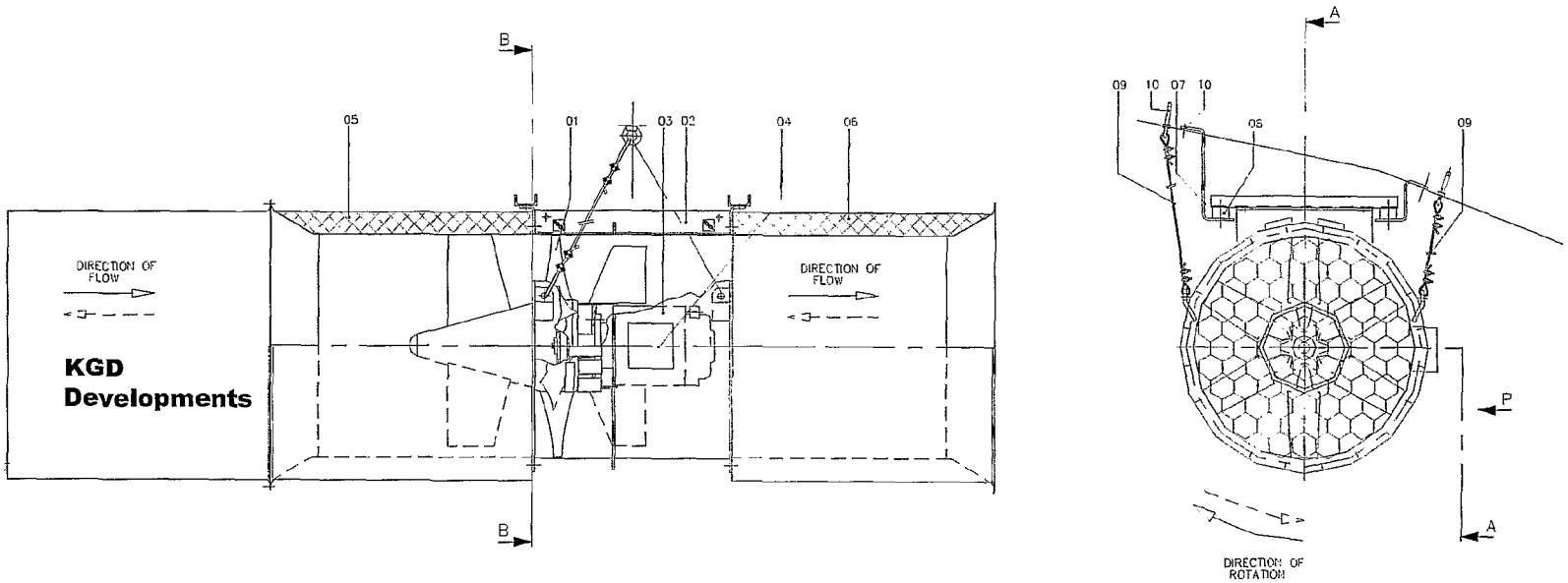
FIG. 8 is the filter system fitted to a typical tunnel jet fan/booster fan.
Figure 9:
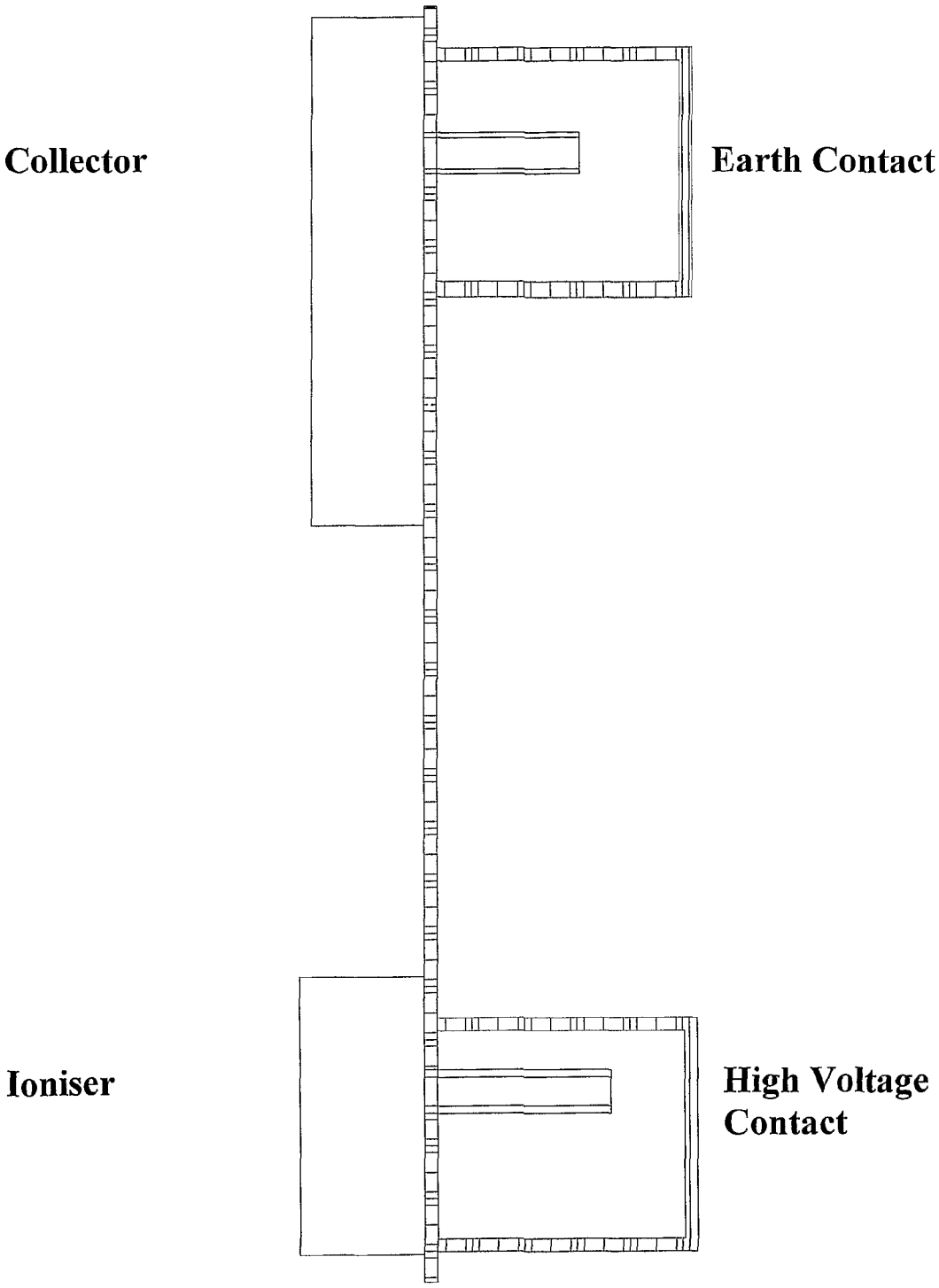
FIG. 9 is a typical filter contact.
Figure 10:
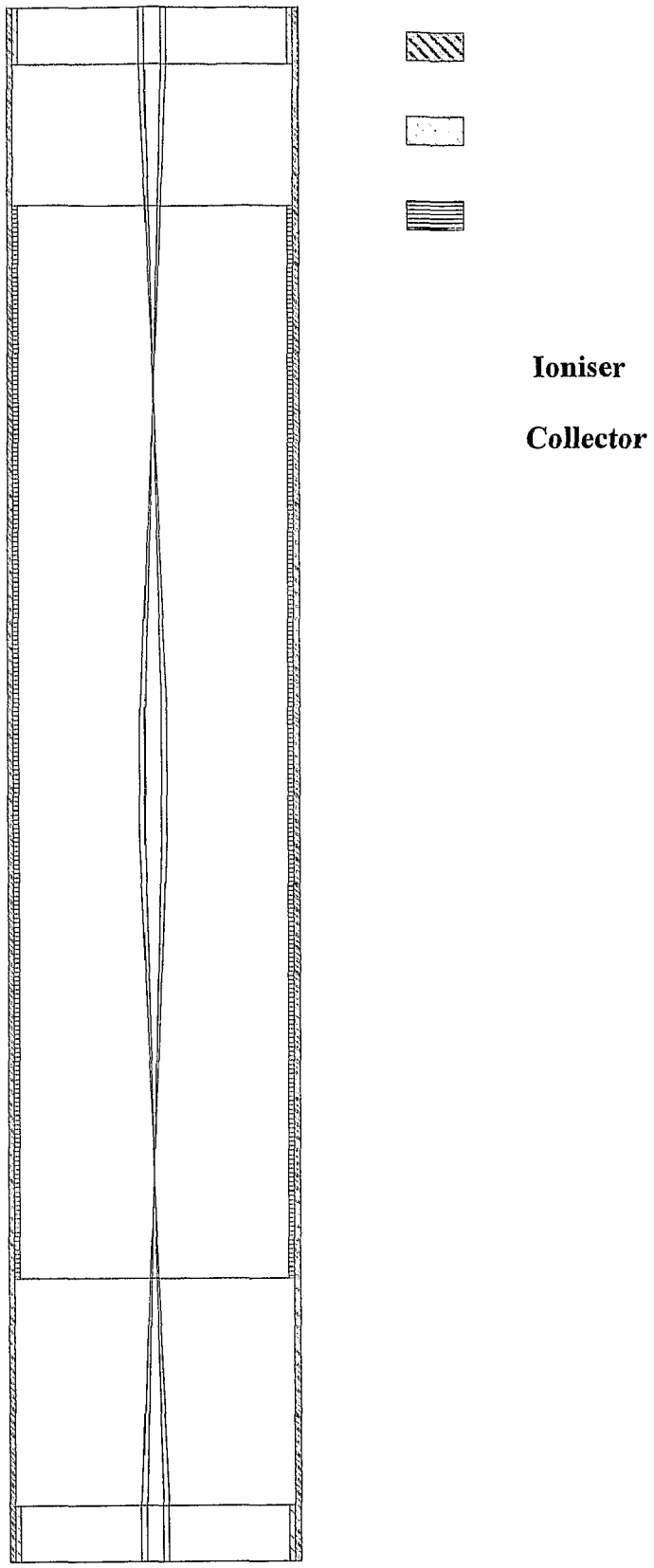
FIG. 10 is the cross-section of a cylindrical tube filter for an air volume of 0.22 $m^3/s$

The electrostatic filter of the present invention is shown in FIG. 3. In this drawing the ioniser shown in FIG. 1 is rotated about its horizontal axis FIG. 2 and is supported in the center of the collector by ioniser supports FIG. 5. The ioniser supports also act as an electrical contact between one ioniser and the adjacent ioniser. FIG. 4 is a typical assembly for a filter capable of filtering 1.54 $m^3/s$. FIG. 6 is a typical assembly for filtering 16.3 $m^3/s$. FIG. 7 is a typical assembly for filtering 54 $m^3/s$. FIG. 8 is an illustration of the Jet Fan Filter fitted to a Jet Fan. FIG. 9 is an illustration of the contacts. The contacts are inside an electrically insulated box. The cables are then connected to the power generator. FIG. 10 is a typical cross-section of a circular tube filter with an air flow of 0.22 $m^3/s$.

The ioniser supports also act as an electrical contact between one ioniser and the adjacent ioniser.

The collector section comprises of hexagonal tubes which are fitted together to form a near circular face which can be adapted to a circular face of a tunnel jet or booster fan.

Each section is fixed to the adjacent by mechanical means. These sections are then encapsulated in a housing which can be fabricated of fire retarded composite material.

Through the composite material are the electrical fixings which pass the high voltage to the ioniser and the collector

The invention claimed is:

1. An apparatus for filtering particulate matter from a gas, comprising a tube defining an axis, an ioniser structure located substantially axially in the tube, and a fan for propelling the gas through the tube at a high speed, wherein the ioniser structure comprises a flat blade extending axially along at least a substantial part of the tube, substantially coinciding with the tube axis, and having a saw tooth shape with a plurality of sharp teeth disposed regularly along edges of the blade, and wherein the blade is twisted about a longitudinal centerline to provide a rotation for the gas being propelled through the tube at high speed, and wherein the apparatus further comprises a collector structure arranged along an inside surface of the tube for receiving particulate matter from the gas that has been rotated and ionised by the ioniser structure.

2. The apparatus of claim 1, wherein the blade twist centerline coincides with the tube axis.

3. The apparatus of claim 1, wherein the blade has a transverse dimension substantially smaller than a tube diameter.

4. The apparatus of claim 1, wherein the tube is made of a composite material, the collector structure inside the tube is made of an electrically conducting material connected to electrical ground, and the ioniser structure is connected to a high electrical potential.

5. The apparatus of claim 1, wherein the twisted blade is supported substantially at the tube axis by electrical conductors for transmitting a high voltage to the blade.

6. The apparatus of claim 1, wherein the tube has a circular, hexagonal, or square shaped cross-section.

7. The apparatus of claim 1, comprising a plurality of the tubes with hexagonal cross-sections.

8. The apparatus of claim 1, wherein the transverse dimension of the blade and the tube diameter have a ratio of 1:10.

9. The apparatus of claim 1, wherein the high speed fan propels the gas at a velocity of 30 m/s or higher.

* * * * *